US006220701B1

(12) United States Patent
Umemura

(10) Patent No.: US 6,220,701 B1
(45) Date of Patent: Apr. 24, 2001

(54) INK CARTRIDGE AND METHOD OF DISASSEMBLING THE SAME

(75) Inventor: Shunji Umemura, Hotaka-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/412,203

(22) Filed: Oct. 5, 1999

(30) Foreign Application Priority Data

Oct. 6, 1998 (JP) ..... 10-284459

(51) Int. Cl.[7] ..... B41J 2/175
(52) U.S. Cl. ..... 347/86
(58) Field of Search ..... 347/85, 86, 87; 428/35.7

(56) References Cited

U.S. PATENT DOCUMENTS 5,712,009 * 1/1998 Moore et al. ..... 428/35.7
5,790,157 * 8/1998 Higuma et al. ..... 347/85
5,790,158 * 8/1998 Shinada et al. ..... 347/86

FOREIGN PATENT DOCUMENTS 08132636 5/1996 (JP) .

* cited by examiner

*Primary Examiner*—N. Le
*Assistant Examiner*—Anh T. N. Vo
(74) *Attorney, Agent, or Firm*—Hogan & Hartson, LLP.

(57) ABSTRACT

An ink cartridge and a method of disassembling the ink cartridge are provided. A casing body has a bottom formed with an ink delivery port extending therethrough. A casing lid joined to the casing body is formed with an air inlet port extending therethrough. The casing body and the casing lid forms a cartridge casing. The cartridge casing is filled with an ink-absorbent material. A delivery port-sealing film seals the ink delivery port. An air inlet port-sealing film seals the air inlet port. A filter is arranged within the casing body at a location inward of the ink delivery port by being inserted thereto from an ink-absorbent material side such that the filter is located between the ink delivery port and the ink-absorbent material. The casing body, the casing lid, the delivery port-sealing film, and the air inlet port-sealing film are formed of a resin material of the same kind. A gap is provided between an underside of the casing lid and a top surface of the ink-absorbent material, for allowing the cartridge casing to be cut thereacross. The ink cartridge is disassembled by the following steps: The ink cartridge is held in a vertically upside-down position. The ink cartridge is cut horizontally across the gap. Then, the filter and the ink-absorbent material are extruded by inserting a pusher from the ink delivery port.

11 Claims, 3 Drawing Sheets

INK CARTRIDGE AND METHOD OF DISASSEMBLING THE SAME

BACKGROUND OF THE INVENTION

1. Field of the Invention

This invention relates to an ink cartridge for use with an ink jet printer, which is produced in view of recycle of resources, and a method of disassembling the same.

2. Prior Art

Conventionally, an ink cartridge to be removably loaded in an ink jet printer was proposed e.g. by Japanese Laid-Open Patent Publication (Kokai) No. 8-132636. The ink cartridge is a type which is connected to a print head by inserting a head needle provided on a print head side of an ink jet printer into an ink delivery port of the ink cartridge. The ink cartridge includes a cartridge casing comprised of a lower casing serving as a casing body and an upper casing serving as a casing lid, and an ink-absorbent material filling the cartridge casing. The ink delivery port is formed through a bottom of the lower casing, and a filter is arranged inward of the ink delivery port between the ink delivery port and the ink-absorbent material. Further, the ink delivery port has a rubber packing mounted on an inner periphery thereof for intimate contact with the head needle connected to the ink cartridge.

The upper casing is formed with an ink-charging port and an air inlet port both extending through a top wall thereof, and a meandering air groove continuous with the air inlet port in the top surface thereof. Further, a delivery port-sealing film is affixed to the bottom surface of the lower casing by thermo-compression bonding such that it seals the ink delivery port, and an air inlet port-sealing film are affixed to the top surface of the upper casing by thermo-compression bonding such that it seals the ink-charging port, the air inlet port, and the meandering air groove.

The upper and lower casings, the delivery port-sealing film, and the air inlet port-sealing film are formed of polypropylene, whereas the ink-absorbent material, the filter, and the rubber packing are formed of urethane, stainless steel, and a synthetic rubber, respectively.

In order to disassemble the conventional ink cartridge constructed as above, for the purpose of recycle, it is required to separate the upper and lower casings, the delivery port-sealing film, and the air inlet port-sealing film (i.e. the component parts formed of polypropylene), each of which is recyclable, from the other component parts which cannot be recycled. To do this, first, the cartridge casing is cut so as to take out the ink-absorbent material and the filter therefrom. However, when the cartridge casing is cut, the ink-absorbent material is cut together with the cartridge casing, which makes assortment of the disassembled component parts troublesome. Further, the ink-absorbent material and the filter are taken out from a portion of the cartridge casing cut open, whereas the rubber packing is required to be taken out after the delivery port-sealing film being peeled off, in a direction opposite to the direction in which the ink-absorbent material is removed. This also makes the separation and assortment of the disassembled component parts troublesome.

SUMMARY OF THE INVENTION

It is a first object of the invention to provide an ink cartridge having a construction which allows easy disassembly of the ink cartridge as well as easy assortment of disassembled component parts of the same according to their materials.

It is a second object of the invention to provide a method of disassembling the ink cartridge.

To attain the first object, according to a first aspect of the invention, there is provided an ink cartridge comprising:

a casing body, the casing body having a bottom formed with an ink delivery port extending therethrough;

a casing lid joined to the casing body, the casing lid being formed with an air inlet port extending therethrough;

the casing body and the casing lid forming a cartridge casing, an ink-absorbent material filling the cartridge casing;

a delivery port-sealing film sealing the ink delivery port;

an air inlet port-sealing film sealing the air inlet port; and a filter arranged within the casing body at a location inward of the ink delivery port by being inserted thereto from an ink-absorbent material side such that the filter is located between the ink delivery port and the ink-absorbent material, wherein the casing body, the casing lid, the delivery port-sealing film, and the air inlet port-sealing film are formed of a resin material of the same kind, and wherein a gap is provided between an underside of the casing lid and a top surface of the ink-absorbent material, for allowing the cartridge casing to be cut thereacross.

According to this ink cartridge, a gap is created between the underside of the casing lid and the top surface of the ink-absorbent material for allowing the cartridge casing to be cut thereacross. This makes it possible to cut the cartridge casing in two without cutting the ink-absorbent material. Further, the ink-absorbent material and the filter accommodated within the cartridge casing can be simultaneously and easily taken out from an opening of a cut portion of the cartridge casing.

Preferably, the underside of the casing lid is formed with a rib protruding downward for holding down the ink-absorbent material.

According to this preferred embodiment, it is possible to positively prevent the ink-absorbent material from invading the gap e.g. due to vibration. Further, it is possible to prevent part of the ink-absorbent material from being drawn into the air inlet port when the cartridge casing is evacuated via the air inlet port during manufacturing, thereby preventing ink absorbed in the ink-absorbent material from being sucked via the air inlet port.

Preferably, the resin material of the same kind is an identical recyclable resin material.

According to this preferred embodiment, it is possible to easily recycle the identical recyclable resin material after the ink cartridge is used up.

For example, the identical recyclable resin material is polypropylene.

To attain the second object, according to a second aspect of the invention, there is provided a method of disassembling an ink cartridge according to the first aspect of the invention.

The method is characterized by comprising the steps of:

holding the ink cartridge in a vertically upside-down position;

cutting the ink cartridge horizontally across the gap; and extruding the filter and the ink-absorbent material by inserting a pusher from the ink delivery port.

According to this method, an ink cartridge held in a vertically upside-down position is cut horizontally across the gap, and a casing lid-side portion of the ink cartridge casing falls. Therefore, it is possible to easily cut the ink cartridge in two such that the casing lid-side portion is separated and falls from the remaining portion without cutting the ink-absorbent material to mix the same with the casing lid side portion of the cartridge casing. Further, when the filter and the ink-absorbent material are extruded by inserting the pusher from the ink delivery port, they also fall, whereby they are easily separated from the casing body. That is, the ink cartridge can be properly disassembled in a single cutting operation and a single extruding operation.

Preferably, the step of cutting the ink cartridge and the step of extruding the filter and the ink-absorbent material are carried out in respective different work areas.

According to this preferred embodiment, even if cuttings are produced e.g. by sawing of the cartridge, it is possible to positively collect the cuttings together with the casing lid.

The above and other objects, features, and advantages of the invention will become apparent from the following detailed description taken in conjunction with the accompanying drawings.

DETAILED DESCRIPTION

Figure 1A:
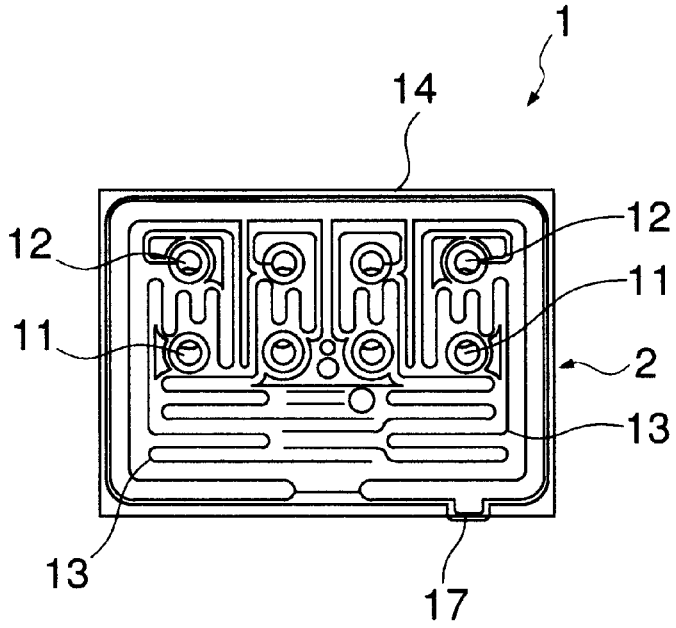
FIG. 1A is a top plan view of an ink cartridge according to an embodiment of the present invention.
Figure 1B:
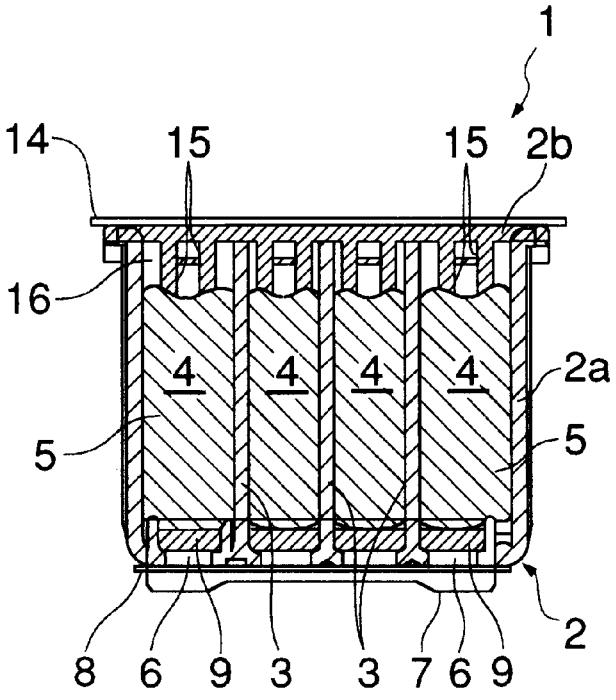
FIG. 1B is a longitudinal sectional view of the ink cartridge.
Figure 1C:
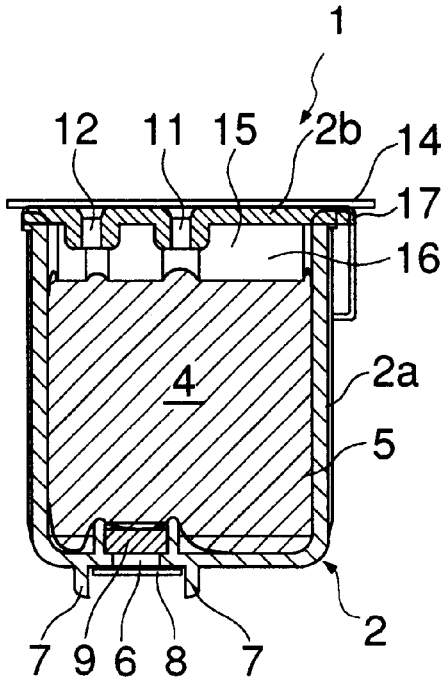
FIG. 1C is a transverse sectional view of the ink cartridge.
Figure 2A:
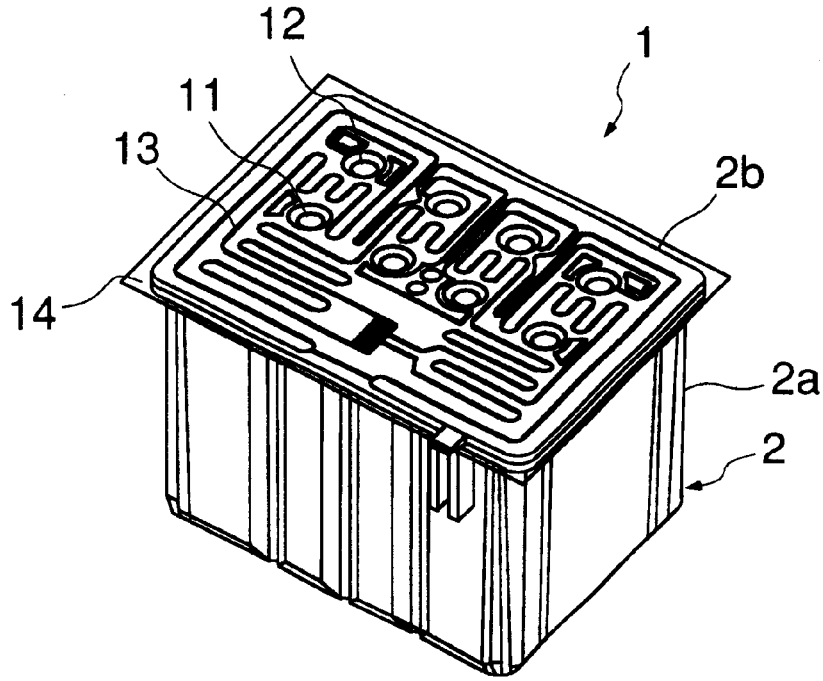
FIG. 2A is a perspective view showing the top of the ink cartridge.
Figure 2B:
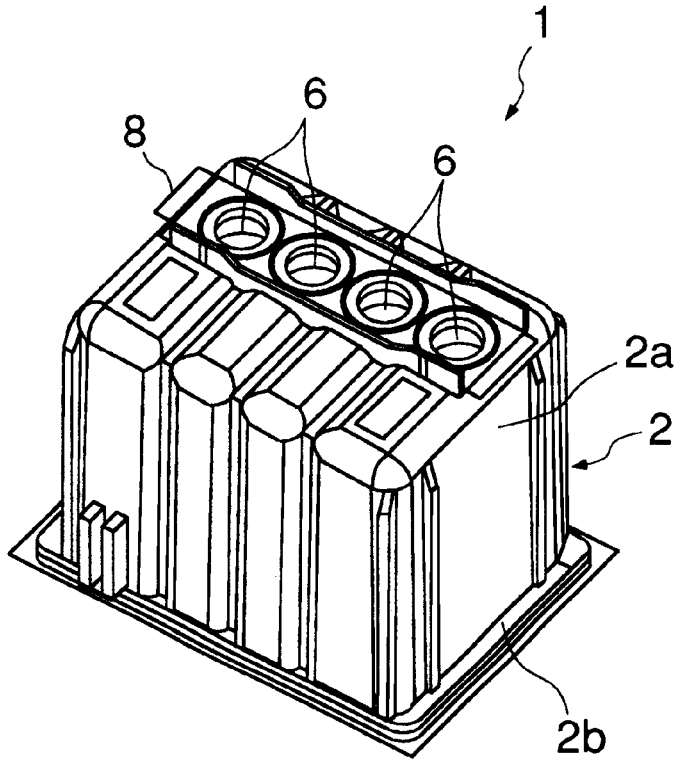
FIG. 2B is a perspective view showing the bottom of the ink cartridge.

The invention will now be described in detail with reference to the drawings showing embodiments thereof. An ink cartridge according to the present invention is used for color printing. FIGS. 1A to 1C show the construction of the ink cartridge, while FIGS. 2A and 2B show appearances of the ink cartridge in perspective. As shown in these figures, the ink cartridge 1 has a cartridge casing 2 generally in the form of a rectangular parallelepiped. The cartridge casing 2 is comprised of a lower casing 2*a* serving as a casing body, and an upper casing 2*b* serving as a casing lid. The upper and lower casings 2*b* and 2*a* are each formed of polypropylene, and the upper casing 2*b* is welded (by vibration welding) to the lower casing 2*a* in a manner closing an open upper end of the lower casing 2*a* to form a unitary member.

The cartridge casing 2 has an inside thereof divided by three partition walls 3 into four ink reservoirs 4. The four ink reservoirs 4 contain cyan, magenta, yellow, and black inks, respectively, each of which is stored in a state absorbed in an ink-absorbent material 5. The ink-absorbent materials 5 are formed e.g. of urethane foam.

The lower casing 2*a* has a bottom thereof formed with four ink delivery ports 6 opening into the respective ink reservoirs 4. The ink cartridge 1 is tightly connected to a print head in surface contact therewith (or removed from the same) via the respective ink delivery ports 6. Further, on an underside surface of the bottom of the lower casing 2*a*, there are formed a pair of protect ribs 7, 7 protruding downward and extending longitudinally on opposite sides of a row of the four ink delivery ports 6. A delivery port-sealing film 8 of polypropylene for sealing the four ink delivery ports 6 is affixed by thermo-compression bonding to a zone of the underside surface of the bottom of the lower casing 2*a* between the pair of protect ribs 7,7. The delivery port-sealing film 8 is peeled off immediately before the ink cartridge is put into use.

The ink delivery ports 6 each have a filter 9 arranged therein at a location downstream of the ink-absorbent material 5 in a manner facing an opening of the ink delivery port 6. The ink absorbed in the ink-absorbent material 5 is supplied to the print head through the filter 9. The filter 9 and the ink-absorbent material 5 are mounted into the lower casing 2*a* from the upper end of the same in the mentioned order.

The upper casing 2*b* has four ink-charging ports 11 and four air inlet ports 12 formed therethrough in a manner corresponding to the respective four ink delivery ports 6. Further, formed in a top surface of the upper casing 2*b* are four meandering air grooves 13, each of which has a proximal end continuous with a corresponding one of the air inlet ports 12. On the other hand, distal ends of the four meandering air grooves 13 are located close to the center of the top surface of the upper casing 2*b*. When a portion of an air inlet port-sealing film 14, referred to hereinafter, covering the distal ends of the four meandering air grooves 13 is peeled off, the air inlet ports 12 are made open to the atmosphere via the meandering air grooves 13.

More specifically, the upper casing 2*b* has the air inlet port-sealing film 14 affixed to the whole top surface thereof by thermo-compression bonding, for sealing the ink-charging ports 11, the air inlet ports 12, and the meandering air grooves 13, and when a portion of the air inlet port-sealing film 14 covering the distal ends of the meandering air grooves 13 is torn off along perforations or the like, the distal ends of the meandering air grooves (meandering passages) 13 are made open to the atmosphere. As the inks within the ink cartridge 1 are supplied to the print head, air is drawn in through each of the meandering air grooves 13 by an amount equivalent to an amount of a corresponding ink supplied to the print head, and introduced into a corresponding ink reservoir of the ink cartridge 1 via a corresponding one of the air inlet ports 12. The meandering air grooves 13 are provided for preventing evaporation of solvent contained in each ink. The air inlet port-sealing film 14 is formed of polypropylene.

The upper casing 2*b* has an underside surface thereof formed with four pairs of spacer ribs 15 protruding downward into the respective ink reservoirs 4. The pairs of spacer ribs 15 are integrally formed with the upper casing 2*b*, for holding down the respective ink-absorbent materials 5. Each of the spacer ribs 15 is formed to have a sufficient protrusion dimension for providing a gap 16 between the underside surface of the upper casing 2*b* and a top surface of the ink-absorbent material 5. This gap 16 is provided so as to allow the cartridge casing 2 to be cut thereacross. More specifically, as described in detail hereinafter, the ink cartridge 1 is cut horizontally (i.e. along a plane extending in parallel with the upper casing 2*b*) across the gap 16 when the ink cartridge 1 is disassembled. In FIG. 1C, reference numeral 17 designates a positioning projection for preventing the ink cartridge 1 from being erroneously mounted with the front side and the rear side reversed, in a cartridge holder arranged on a print head side of an ink jet printer.

Next, the method of disassembling the ink cartridge 1 will be described with reference to FIGS. 3A to 3C. As described above, the upper and lower casings 2*b*, 2*a* of the ink cartridge 1, the delivery port-sealing film 8, and the air inlet port-sealing film 14 are formed of polypropylene which is recyclable, while the ink-absorbent materials 5 and the filters 9 are formed of other materials, respectively. Therefore, according to this disassembling method, the upper and lower casings 2*b*, 2*a* and the two films 8, 14 are disassembled completely separate from the ink-absorbent materials 5 and the filters 9.

Figures 3A, 3B, 3C:
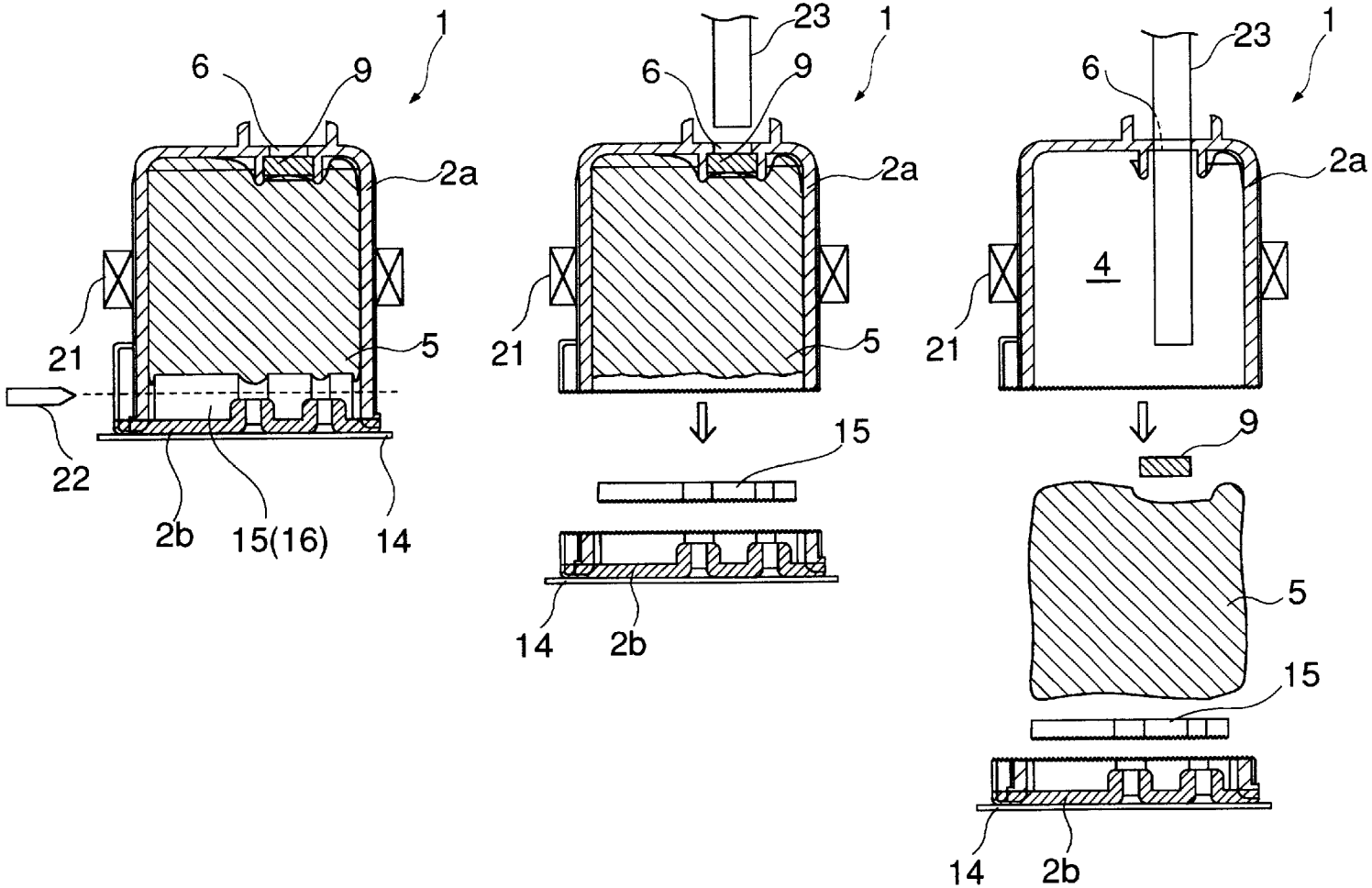
FIGS. 3A to 3C are explanatory views showing a sequence of steps of disassembling the ink cartridge.

First, as shown in FIG. 3A, the ink cartridge 1 is turned upside down and held in this position, i.e. a vertically upside-down position by a holding jig 21. Then, the ink cartridge 2 is cut horizontally across the gaps 16 e.g. by using a sawing cutter 22. When the ink cartridge 1 is cut, the upper casing 2*b* and an upper end portion of the lower casing 2*a* continuous therewith are separated and fall. At the same time, portions of the spacer ribs 15 cut off from the upper casing 2*b* separate from the respective ink-absorbent materials 5 and also fall (see FIG. 3B). On the other hand, the ink-absorbent materials 5 filled in the ink cartridge 1 in a compressed state cannot fall even when the ink cartridge 1 is cut.

The remainder of the ink cartridge 1 held by the holding jig 21 is carried to another work area. Then, a cylindrical pusher 23 is inserted into the ink cartridge 1 from each of the ink delivery ports 6 to extrude the filter 9 and the ink-absorbent material 5 from the lower casing 2*a*. The filter 9 and the ink-absorbent material 5 are extruded from the lower casing 2*a* and fall (FIG. 3C). When the above-mentioned sequence of disassembling operations is completed, the lower casing 2*a* held by the holding jig 21, as well as the upper casing 2*b* (including the air inlet port-sealing film 14) and the spacer ribs 15 which were cut off in the first work area are collected together with cuttings. Further, the filters 9 and the ink-absorbent materials 5 are collected separately from the above component parts. In general, an ink cartridge 1 to be disassembled is a used-up one with a delivery port-sealing film 8 already peeled off. Therefore, it is preferable that the delivery port-sealing film 8 is collected separately by a special method therefor.

As described above, according to the present embodiment, the spacer ribs 15 are provided to hold down the ink-absorbent materials 5 such that the gap 16 is created which is large enough to permit the ink cartridge 1 to be cut thereacross between the underside surface of the upper casing 2*b* and the top surface of the ink-absorbent material 5. In disassembling the used cartridge 1, the ink cartridge 1 is cut horizontally across the gap 16. Therefore, it is possible to cut the ink cartridge 1 without cutting the ink-absorbent materials 5, as a result of which the disassembled component parts can be assorted according to their materials with ease. Additionally, since the cutting of the ink cartridge 1 and the extrusion of the filters 9 and the ink-absorbent materials 5 from the ink cartridge 1 are carried out in different work areas, cuttings produced during the cutting can also be collected positively.

Further, since the filter 9 and the ink-absorbent material 5 are mounted into each of the ink reservoirs 5 from the upper end of the lower casing 2*a* in the mentioned order, it is possible to extrude the filter 9 and the ink-absorbent material 5 from the ink cartridge 1 easily in a single extruding operation. This facilitates disassembly of the ink cartridge 1 and assortment of the component parts of the same according to their materials, thereby enabling positive recycle of resources.

Although in the above embodiment, the upper and lower casings, the delivery port-sealing film, and the air inlet port-sealing film are each formed of polypropylene, this is not limitative, but it goes without saying that they may be formed of any other suitable recyclable resin.

It is further understood by those skilled in the art that the foregoing is a preferred embodiment of the invention, and that various changes and modifications may be made without departing from the spirit and scope thereof.

What is claimed is:

1. An ink cartridge comprising:

a casing body, said casing body having a bottom formed with an ink delivery port extending therethrough;

a casing lid joined to said casing body, said casing lid being formed with an air inlet port extending therethrough;

said casing body and said casing lid mating at a junction therebetween and forming a cartridge casing, an ink-absorbent material filling said cartridge casing;

a delivery port-sealing film sealing said ink delivery port;

an air inlet port-sealing film sealing said air inlet port; and a filter arranged within said casing body at a location inward of said ink delivery port by being inserted thereto from an ink-absorbent material side such that said filter is located between said ink delivery port and said ink-absorbent material, wherein said casing body, said casing lid, said delivery port-sealing film, and said air inlet port-sealing film are formed of a resin material of the same kind, wherein a uniform gap is provided between an underside of said casing lid and a top surface of said ink-absorbent material, for allowing said cartridge casing to be cut thereacross, and wherein said underside of said casing lid is formed with a rib protruding downward for holding down said ink-absorbent material, the rib protruding downward below said junction between said casing body and said casing lid to keep said top surface of said ink-absorbent material below said junction.

2. The ink cartridge according to claim 1, wherein said resin material of the same kind is an identical recyclable resin material.

3. The ink cartridge according to claim 2, wherein said identical recyclable resin material is polypropylene.

4. The ink cartridge according to claim 1, wherein said resin material of the same kind is an identical recyclable resin material.

5. The ink cartridge according to claim 4, wherein said identical recyclable resin material is polypropylene.

6. A method of disassembling an ink cartridge comprising:

a casing body, said casing body having a bottom formed with an ink delivery port extending therethrough;

a casing lid joined to said casing body, said casing lid being formed with an air inlet port extending therethrough;

said casing body and said casing lid mating at a junction therebetween and forming a cartridge casing, an ink-absorbent material filling said cartridge casing;

a delivery port-sealing film sealing said ink delivery port;

an air inlet port-sealing film sealing said ink delivery port;

a filter arranged within said casing body at a location inward of said ink delivery port by being inserted thereto from an ink-absorbent material side such that said filter is located between said ink delivery port and said ink-absorbent material, wherein said casing body, said casing lid, said delivery port-sealing film, and said air inlet port-sealing film are formed of a resin material of the same kind, wherein a uniform gap is provided between an underside of said casing lid and a top surface of said ink-absorbent material, for allowing said cartridge casing to be cut thereacross, and wherein said underside of said casing lid is formed with a rib protruding downward for holding down said ink-absorbent material, the rib protruding downward below said junction between said casing body and said casing lid to keep said top surface of said ink-absorbent material below said junction, the method comprising the steps of:

holding said ink cartridge in a vertically upside-down position;

cutting said ink cartridge horizontally across said gap; and extracting said filter and said ink-absorbent material by inserting a pusher from said ink delivery port.

7. The method according to claim 6, wherein the step of cutting said ink cartridge and the step of extruding said filter and said ink-absorbent material are carried out in respective different work areas.

8. The ink cartridge according to claim 7, wherein said resin material of the same kind is an identical recyclable resin material.

9. The ink cartridge according to claim 8, wherein said identical recyclable resin material is polypropylene.

10. The ink cartridge according to claim 6, wherein said resin material of the same kind is an identical recyclable resin material.

11. The ink cartridge according to claim 10, wherein said identical recyclable resin material is polypropylene.

* * * * *